United States Patent [19]

Dillon

[11] 4,050,213

[45] Sept. 27, 1977

[54] METHOD OF ERECTING A MULTI-STORY BUILDING

[75] Inventor: Thomas J. Dillon, Akron, Ohio

[73] Assignee: Thomas J. Dillon & Co., Inc., Cleveland, Ohio

[21] Appl. No.: 286,443

[22] Filed: Sept. 5, 1972

Related U.S. Application Data

[63] Continuation of Ser. No. 29,508, April 17, 1970, abandoned.

[51] Int. Cl.[2] ..... E04B 1/35

[52] U.S. Cl. ..... 52/743; 52/251; 52/259; 52/262; 52/434

[58] Field of Search ..... 52/743, 744, 323, 252, 52/253, 262, 434, 251, 259

[56] References Cited

U.S. PATENT DOCUMENTS

| | | | |
|---|---|---|---|
| 791,875 | 6/1905 | Buente | 52/250 X |
| 1,627,000 | 5/1927 | Yeager | 52/723 X |
| 1,677,577 | 7/1928 | Amiot | 52/634 X |
| 1,757,077 | 5/1930 | Eiserloh | 52/289 |
| 1,863,981 | 6/1932 | Groves | 52/324 X |
| 1,979,642 | 11/1934 | Sahlberg | 52/723 X |
| 2,071,378 | 2/1937 | Arnn | 52/723 |
| 2,112,949 | 4/1938 | Bunker | 52/326 X |
| 2,844,024 | 7/1958 | McDonald | 52/648 X |
| 3,283,466 | 11/1966 | Grebner et al. | 52/723 X |
| 3,357,147 | 12/1967 | Lerner | 52/326 |
| 3,389,521 | 6/1968 | Gregori | 52/251 X |
| 3,562,979 | 2/1971 | Ali-Oglu | 52/252 |
| 3,763,613 | 10/1973 | Wise | 52/447 |

FOREIGN PATENT DOCUMENTS

| | | | |
|---|---|---|---|
| 1,213,880 | 11/1959 | France | 50/181 |
| 535,517 | 11/1955 | Italy | 52/723 |
| 39,809 | 4/1957 | Poland | 52/272 |
| 419,527 | 3/1967 | Switzerland | 52/251 |

*Primary Examiner*—Leslie Braun
*Attorney, Agent, or Firm*—Reese Taylor

[57] ABSTRACT

An improved method of concrete building slab construction comprising positioning a precast base portion having longitudinally extending bridge-type reinforcing units or joists pre-stressed in place therein, with the reinforcing units being transversely stiffened on precast concrete wall panels having vertical voids and covering the slabs with concrete during final pouring operations at the building site wherein the concrete enters the vertical voids.

1 Claim, 5 Drawing Figures

FIG. 1
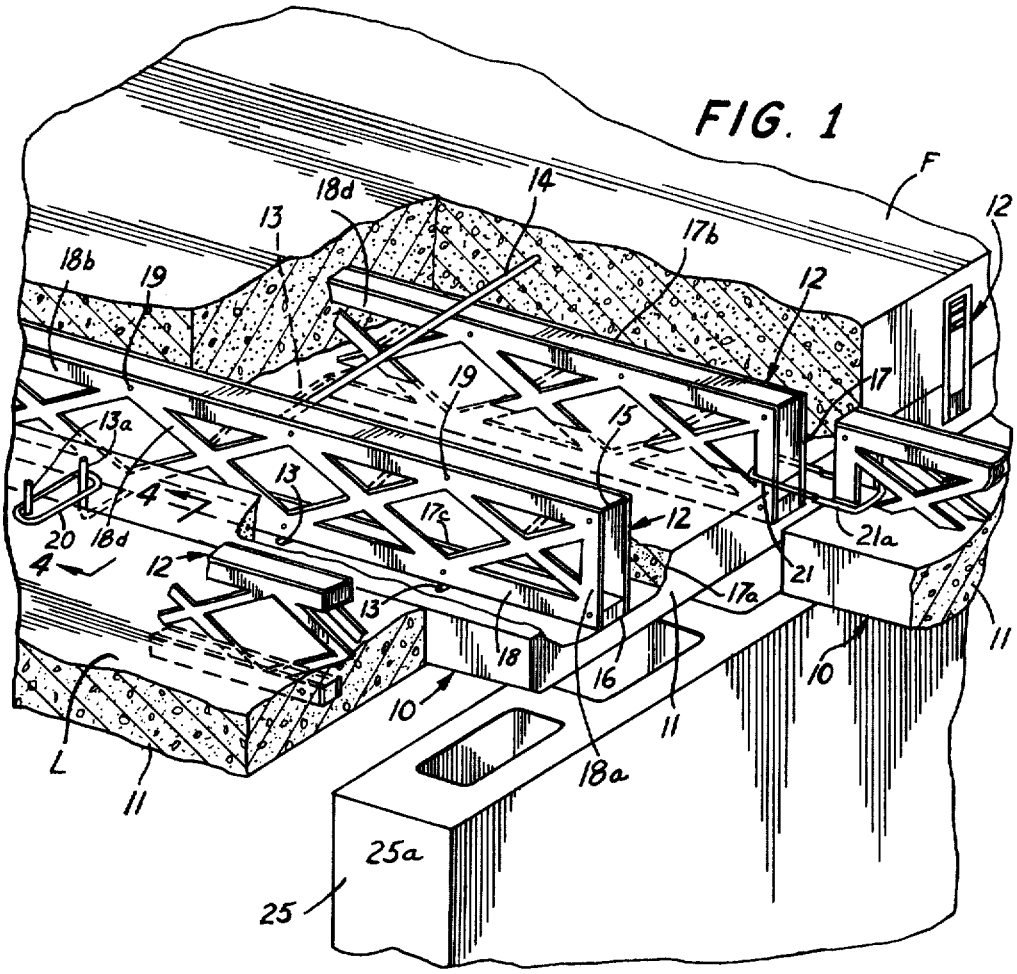
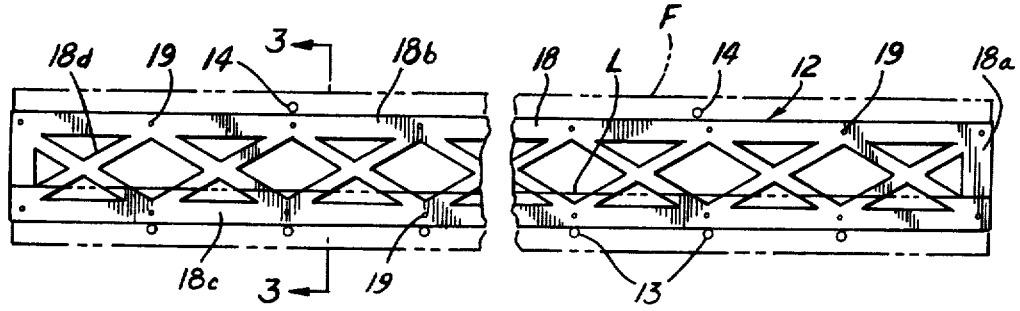
FIG. 2

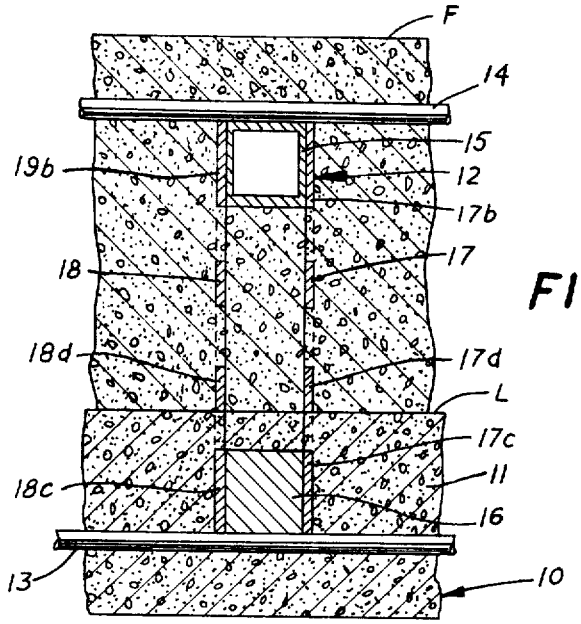
FIG. 3
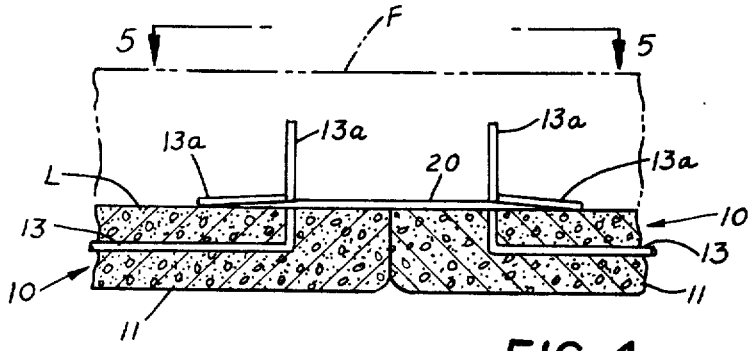
FIG. 4
FIG. 5
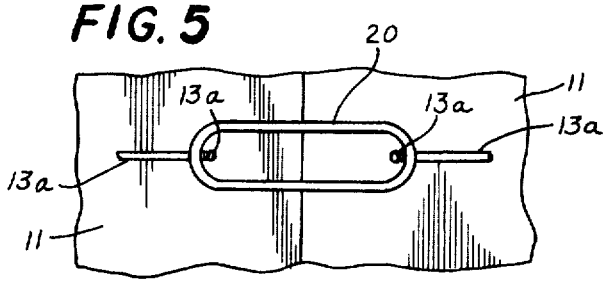

METHOD OF ERECTING A MULTI-STORY BUILDING

RELATED APPLICATIONS

This application is an improvement on the type of building slab construction shown in Applcant's co-pending application entitled "Unitized Building Structure Utilizing Precast Components" filed Jan. 12, 1970, as Ser. No. 2,177 and now U.S. Pat. 3,662,506, and is a continuation of Applicant's earlier filed application filed Apr. 17, 1970, as Ser. No. 29,508 for "Improved Building Slab," now abandoned.

BACKGROUND OF THE INVENTION

Applicant's above-identified co-pending application discloses an improved method of building construction characterized by unitizing or binding the precast wall and floor portions of a building during final pouring of the concrete, and that application discloses one form of building slab having longitudinally extending concrete reinforcing ribs.

In applications involving different structural requirements, such as where relatively short spans are involved, it is desirable that the slab be reinforced either by prestressing or by adding reinforcing members, such as joists or the like, that serve to provide support against vertical deflections during periods of use. This application relates principally to a building slab meeting the above requirments.

DESCRIPTION OF THE PRIOR ART

High-rise construction of the general type herein being discussed has long been known in the building construction industry. In the past, various methods and approaches have been taken to this subject, with the type of construction that has been and is being employed varying considerably.

Because of rising wage and labor costs in the construction industry, recent attempts have been directed to preforming as many of the components of the building as possible at factory locations so that the same can be then erected at the site with minimal use of skilled artisans, such as bricklayers, etc.

In this regard, it is known at the present time that concrete floor panels can be precast. However, at the present time weight and space requirements have limited the degree to which precast components can be employed. Weight in this regard is not only important from a shipping standpoint, but is important from the standpoint of the ease of erection and handling that is involved at the building site.

Thus it becomes axiomatic that while the use of precast components is desirable, it is mandatory that such components be capable of being supported and erected without unusual effort and expensive equipment being required.

To this end, construction techniques at the pesent time include the pouring or laying up of the vertical walls at the site. The walls then receive precast floor components that are only partially poured as regards their thickness. Once these slabs are positioned in place at the site, the remaining portion of the slab is poured so that the finished product is completed.

While the above technique has resulted in a technical advance, there still remains the difficulty of fusing the floors to vertical wall components, and also there is an inability, in the known art, to erect several stories before final pouring.

Additionally, and as indicated above, Applicant's earlier invention envisioned the use of a panel having precast concrete ribs therein, with the precast ribs being placed in such a manner that when the same were covered during final pour, the same cement would flow into vertical voids in the wall units and thus unitize the wall and floor components together.

SUMMARY OF THE INVENTION

Applicant has found that a floor slab havig greatly increased strength characteristics can be achieved by utilizing a low-cost bridge type construction in combination with partially poured slabs of the type above described. In practice, Applicant utilizes a pair of rods that have their opposed surfaces connected by a stamped-out sheet metal portion so as to form a box-like girder construction that extends longitudinally of the slab and is partially embedded therein during the initial pouring.

Stability is added in this regard by the use of transverse rod members provided on the top and bottom so as to, in effect, transversely present a rectangle that has great resistence against lateral shear forces. By providing openings in the opposed bridge components, as just described, it is believed apparent that the ease of installation of utility conduits, etc., is greatly enhanced, it being a simple matter to pass a cord or conduit through the openings in the bridge frames prior to final pour.

It is also believed apparent that by substituting a steel ridge-like component for the integral rib shown in Applicant's earlier application, that increased productivity can be achieved due to the fact that the set-up time required before the forms can be stripped is materially reduced.

Production of the improved building slab having the above characteristics accordingly becomes the principal object of this invention, with other objects thereof becoming more apparent upon a reading of the following brief specification, considered and interpreted in view of the accompanying drawings.

DESCRIPTION OF THE DRAWINGS

FIG. 1 is a perspective view, partly broken away in section, and illustrating the improved building slab in place on a supporting wall.

FIG. 2 is a side elevational view of the improved slab as the same is delivered to the site.

FIG. 3 is a vertical section taken on the lines 3—3 of FIG. 2.

FIG. 4 is a vertical section taken on the lines 4—4 of FIG. 1.

FIG. 5 is a plan view taken on the lines 5—5 of FIG. 4.

PREFERRED EMBODIMENT OF THE INVENTION

Referring now to the drawings, and in particular to FIG. 1, each improved building slab, generally designated by numeral 10, includes a base portion 11 and a series of longitudinally extending, partially embedded bridge or joist members 12,12 that extend longitudinally of the slab in parallel relationship with each other, as best shown in FIGS. 1 and 2 of the drawings.

Additionally, and as shown in FIGS. 1 and 2, the bottom portion 16 of each frame member 12 is tack welded to transverse reinforcing rods 13,13 while similar reinforcing rods 14,14 extend transversely of the members 12,12 and are tack welded on their top surfaces, as clearly shown in FIG. 1 of the drawings.

Referring now to FIGS. 1, 2, and 3, the individual bridge members 12,12 are preferably identical in configuration and accordingly include an elongate tubular frame member 15, an elongate solid lower core member 16, and opposed sheet metal side plates 17 and 18, with these just described components being welded together as indicated at 19,19.

These side plates 17 and 18 are preferably identical and are rectangular in shape, having opposed end pieces **17*a*,18*a* which are connected to opposed top and bottom pieces 17*b*,17*c*, 18*b*,18*c*. These top and bottom pieces are interconnected by cross members 17*d*,18*d*** which are X-shaped an span the distance between the top and bottom pieces to provide a truss-like bracing effect for greater rigidity.

In the preferred form of the invention, the upper frame 15 is shown hollow or tubular in configuration while the lower frame 16 is shown solid so as to permit pre-stressing when the same is placed within the base portion 11 during manufacture.

The reason for this construction is that the finished slab 10 goes into compression on its top surface and tension on its bottom surface when load is applied. The solid lower core member 16 is more capable of resisting tension, while the hollow frame 15 does not need this capability.

Referring now to FIGS. 4 and 5, it will be noted that one or more of the lower transverse rods 13,13 is extended to beyond the edge of the slab 10 so as to permit the outboard portion to be bent upwardly, as indicated in **13*a* in FIGS. 4 and 5 of the drawings. By this arrangement an endless metal loop 20 can be positioned adjacent rod ends 13*a*,13*a* of adjacent slabs 10,10, following which the same can be bent downwardly to the chain-dotted line position of FIG. 4** so as to effectuate a drawing together and longitudinal abutting of adjacent block members.

Similarly, as shown in FIG. 1, half loops **21,21*a* can be positioned about the spaced-apart ends of joist members 12,12 of adjacent slab members and secured together by welding or turn-buckle arrangements, or fastening members so as to secure these members in place as shown in FIG. 1. Alternatively, these members 21,21*a* could be bent downwardly at right angles so as to bear against the walls of the voids 25*a* that are provided in the vertical wall member 25**, with methods of attachment of this type being clearly shown in Applicant's above referred to co-pending application and with it being apparent that such methods are capable of being utilized interchangeably dependent upon field conditions.

In production of the improved slab, it is contemplated that a series of joist or truss units 12,12 will be made up to assembled form of the proper length and height. When this has been accomplished, these need merely be placed in the appropriate form that will be utilized for pouring the base 11, with it being understood that the member 16 can be pre-stressed or not, as required.

When the slab 11 has been poured to the height L, it is merely necessary to allow the same to set, and when hardening takes place, the forms can be removed and the unit 10 removed for transportation to the job site. It should be noted that prior to pouring, the rods 13,13 and 14,14 would have been tack welded in place to make an entire bridging or truss sub-assembly that would be positioned in place prior to final pouring on the job site. It is also to be remembered that one or more of the lower rods **13*a* would have been bent upwardly to the vertical position shown in FIG. 4**.

When the slabs have been completed, as just described, it is believed apparent that the same can be stacked upon each other for delivery to the building site. Once at the building site it is merely necessary that a crane or other device have its hook or sling component pass through one or more of the joists 12,12, at which time the slab 10 may be lifted into place and positioned on the vertical wall unit 25, as shown in FIG. 1 of the drawings. As additional slabs are positioned in place, they will be connected together both at their sides and ends as earlier indicated. In this regard side-to-side connection can be effectuated by positioning the loop 20 to the position shown in FIG. 4, and then peening or bending members **13*a* to the chain-dotted position shown in FIG. 4**.

As regards positioning the slabs 10,10 on wall 25, the ends of the units will be positioned to overlie the voids **25*a*,25*a* as earilier described, and as shown in FIG. 1, and at this time the fastening components 21 and 21*a*** will be employed to effectuate interconnection of longitudinally co-extensive slab members.

The necessary utility conduits can then be positioned followed by the final pour up to line F of FIG. 3. In this regard the final pour concrete will not only cover the slab 10 but will pass into voids **25*a*,25*a*** so that the finished product will be a unitized structure, as taught by Applicant's copending application earlier referred to.

While a full and complete description of the invention has been set forth in accordance with the dictates of the Patent Statutes, it is to be understood that the invention is not intended to be limited to the spcific form herein shown. Accordingly, modifications of the invention may be resorted to without departing from the spirit hereof or the scope of the appended claims.

What is claimed is:

1. A method of erecting a multi-story building on a prepared foundation site, comprising the steps of A. erecting a plurality of pre-cast concrete wall panels in horizontally aligned, parallel relationship with each other, with each panel forming one wall of a room of said building and having at least one vertical void extending between the top and bottom surfaces thereof;

B. spanning adjacent parallel wall panels with a series of partial thickness pre-cast concrete floor slabs of uniform thickness that have longitudinally extending reinforcing girder-like means provided therein, with at least a portion of said reinforcing means being embedded in said floor slabs projecting inwardly from the upper surface thereof and with opposed ends of said floor slabs resting on the top edges of said wall panels and being spaced from the ends of the slabs spanning the next adjacent pair of wall panels;

C. transversely and longitudinally aligning the longitudinal ends of said floor slabs in non-covering relationship to said voids in said walls panels;

D. securing by first securing means each said slab against lateral movement with respect to a laterally adjacent slab;

E. securing by second securing means said longitudinally aligned floor slabs against longitudinal movement with respect to he longitudinally aligned slabs that are supported on said panels on the opposite side of said voids;

F. pouring a substantially uniform thickness layer of concrete in situ onto the upper surface of said aligned slabs and into said voids so as to cover said slabs, said reinforcing means and said positioned first and second securing means and simultaneously fill said voids with a column of site-poured concrete from top to bottom thereof and thereby effectuate concrete fusion between said wall panels and said floor slabs whereby a monolithic structure is formed; and G. prestressing at least the portion of said reinforcing means that is embedded in said partial thickness floor slabs.

* * * * *